US012515113B2

(12) United States Patent
Hettinger et al.

(10) Patent No.: US 12,515,113 B2
(45) **Date of Patent: *Jan. 6, 2026**

(54) GOLF CLUB HEAD WITH ADJUSTABLE WEIGHTING

(71) Applicant: Acushnet Company, Fairhaven, MA (US)

(72) Inventors: Ronald K. Hettinger, Oceanside, CA (US); Kevin Tassistro, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 84 days.

This patent is subject to a terminal disclaimer.

(21) Appl. No.: 18/422,667

(22) Filed: Jan. 25, 2024

(65) Prior Publication Data

US 2024/0157206 A1 May 16, 2024

Related U.S. Application Data

(63) Continuation of application No. 17/898,896, filed on Aug. 30, 2022, now Pat. No. 11,911,672.

(51) Int. Cl.
*A63B 53/04* (2015.01)
*A63B 53/06* (2015.01)
*A63B 53/08* (2015.01)

(52) U.S. Cl.
CPC ..... *A63B 53/06* (2013.01); *A63B 53/047* (2013.01); *A63B 53/08* (2013.01); *A63B 2053/0479* (2013.01)

(58) Field of Classification Search
CPC ..... A63B 2053/0491
See application file for complete search history.

(56) References Cited

U.S. PATENT DOCUMENTS

| | | | | |
|---|---|---|---|---|
| 645,942 | A * | 3/1900 | Cran | A63B 53/047 473/336 |
| 2,332,342 | A | 10/1943 | Reach | |
| 4,340,230 | A * | 7/1982 | Churchward | A63B 53/04 473/339 |
| 4,420,156 | A | 12/1983 | Campau | |
| 4,867,458 | A | 9/1989 | Sumikawa | |
| 5,050,879 | A | 9/1991 | Sun | |
| 5,629,475 | A | 5/1997 | Chastonay | |
| 6,015,354 | A | 1/2000 | Ahn et al. | |
| 6,592,468 | B2 | 7/2003 | Vincent | |
| 6,811,496 | B2 * | 11/2004 | Wahl | A63B 53/047 473/345 |

(Continued)

FOREIGN PATENT DOCUMENTS

| | | | | |
|---|---|---|---|---|
| FR | 2581320 A1 * | 11/1986 | | A63B 53/0433 |
| GB | 1387955 A * | 3/1975 | | A63B 53/047 |

(Continued)

*Primary Examiner* — Alvin A Hunter
(74) *Attorney, Agent, or Firm* — Randy K. Chang

(57) ABSTRACT

A golf club head with an improved adjustable weighting system for an iron and/or wedge type golf club head is disclosed herein. More specifically, the golf club head in accordance with the present invention provides an improved weighting system that fits in seamlessly with the traditional shaping of a wedge type golf club head that preserves the aesthetics of the golf club head that golfer have come to expect.

13 Claims, 10 Drawing Sheets

(56) References Cited

U.S. PATENT DOCUMENTS 6,923,734 B2 * 8/2005 Meyer ..... A63B 60/02 473/341
7,083,530 B2 * 8/2006 Wahl ..... A63B 53/047 337/350
7,410,425 B2 8/2008 Willett et al.
7,530,903 B2 5/2009 Imamoto
7,704,163 B2 * 4/2010 Stites ..... A63B 53/047 473/334
8,088,019 B1 1/2012 Long et al.
8,337,325 B2 * 12/2012 Boyd ..... A63B 60/02 473/332
8,696,491 B1 4/2014 Myers
8,715,106 B1 5/2014 Seluga
8,777,774 B1 7/2014 Kim et al.
8,911,304 B1 12/2014 Dawson
9,079,081 B2 7/2015 Shimazaki
9,211,453 B1 * 12/2015 Foster ..... A63B 53/06
9,259,627 B1 * 2/2016 Myers ..... A63B 53/04
9,623,302 B1 * 4/2017 Myers ..... A63B 53/0466
9,694,256 B2 * 7/2017 Myers ..... A63B 53/0466
10,213,665 B1 * 2/2019 Day ..... A63B 53/0466
10,463,928 B2 11/2019 Stokke
10,543,406 B2 * 1/2020 Carter ..... A63B 53/0466
10,596,428 B1 * 3/2020 Rumble ..... A63B 60/02
10,695,628 B1 * 6/2020 Yi ..... A63B 53/08
10,926,143 B2 * 2/2021 Bennett ..... A63B 60/02
11,052,294 B2 * 7/2021 Carter ..... A63B 60/00
11,090,536 B2 * 8/2021 Bennett ..... A63B 53/08
11,135,486 B2 * 10/2021 Higdon ..... A63B 53/0408
11,439,877 B2 * 9/2022 Northcutt ..... A63B 60/04
11,439,878 B2 * 9/2022 Bennett ..... A63B 53/047
11,439,879 B2 * 9/2022 Yi ..... A63B 60/52
11,497,974 B2 * 11/2022 Northcutt ..... A63B 53/0466
11,684,830 B2 * 6/2023 Mizutani ..... A63B 53/0466 473/345
11,691,057 B2 * 7/2023 Bennett ..... A63B 53/08 473/335
11,911,672 B1 * 2/2024 Hettinger ..... A63B 53/06
11,925,841 B2 * 3/2024 Yi ..... A63B 53/0466
12,005,327 B2 * 6/2024 Hettinger ..... A63B 60/02
12,102,895 B2 * 10/2024 Funaki ..... A63B 53/0466
12,246,227 B2 * 3/2025 Bennett ..... A63B 53/08
2002/0068645 A1 6/2002 Vincent
2002/0165041 A1 11/2002 Takeda
2003/0013545 A1 1/2003 Vincent
2003/0032499 A1 * 2/2003 Wahl ..... A63B 53/047 473/334
2005/0143190 A1 6/2005 Takeda
2008/0020861 A1 * 1/2008 Adams ..... A63B 60/00 473/336
2011/0021285 A1 1/2011 Shimazaki
2011/0039634 A1 * 2/2011 Tavares ..... A63B 53/06 473/335
2012/0196702 A1 8/2012 Shimazaki
2013/0344988 A1 12/2013 Hettinger
2016/0101330 A1 4/2016 Harrington
2016/0129323 A1 * 5/2016 Myers ..... A63B 53/0466 473/338
2016/0184665 A1 6/2016 Nakamura
2019/0192928 A1 * 6/2019 Soracco ..... A63B 60/04
2020/0330834 A1 * 10/2020 Northcutt ..... A63B 53/045
2020/0330835 A1 * 10/2020 Bennett ..... A63B 53/06
2020/0330836 A1 * 10/2020 Bennett ..... A63B 60/02
2021/0128994 A1 * 5/2021 Yi ..... A63B 53/047
2021/0138318 A1 * 5/2021 Northcutt ..... A63B 53/0466
2021/0138319 A1 * 5/2021 Bennett ..... A63B 53/047
2021/0299525 A1 * 9/2021 Mizutani ..... A63B 53/04
2021/0402270 A1 * 12/2021 Bennett ..... A63B 60/02
2022/0111263 A1 * 4/2022 Yi ..... A63B 53/0433
2023/0271066 A1 * 8/2023 Mizutani ..... A63B 53/0466 473/345
2023/0285817 A1 * 9/2023 Bennett ..... A63B 60/02
2023/0330499 A1 * 10/2023 Yi ..... A63B 60/52
2023/0338794 A1 * 10/2023 Hettinger ..... A63B 53/047
2024/0066366 A1 * 2/2024 Yi ..... A63B 53/047
2024/0066367 A1 * 2/2024 Hettinger ..... A63B 60/02
2024/0066368 A1 * 2/2024 Ines ..... A63B 53/08
2024/0157206 A1 * 5/2024 Hettinger ..... A63B 53/047
2024/0226673 A1 * 7/2024 Cleghorn ..... A63B 60/02
2024/0316420 A1 * 9/2024 Yi ..... A63B 53/08
2024/0316422 A1 * 9/2024 Yi ..... A63B 60/52
2024/0359064 A1 * 10/2024 Hettinger ..... A63B 53/06

FOREIGN PATENT DOCUMENTS

GB 2094158 A * 9/1982 ..... A63B 53/04
JP 2729760 B2 * 3/1998
JP 2005058765 A * 3/2005 ..... A63B 53/047
JP 2007319687 A * 12/2007 ..... A63B 60/02
JP 2019000664 A * 1/2019 ..... A63B 53/06
JP 2019042192 A * 3/2019
KR 19990076463 A * 10/1999 ..... A63B 53/0487
KR 20110033462 A * 3/2011 ..... A63B 53/047
KR 20130005384 A * 1/2013 ..... A63B 53/047
KR 101401409 B1 * 5/2014 ..... A63B 53/007
KR 20160121568 A * 10/2016 ..... A63B 53/08
TW 201538208 A * 10/2015 ..... A63B 53/0408
WO WO-0243819 A2 * 6/2002 ..... A63B 60/02
WO WO-2007044220 A1 * 4/2007 ..... A63B 53/06
WO WO-2015123661 A1 * 8/2015 ..... A63B 53/06

* cited by examiner

GOLF CLUB HEAD WITH ADJUSTABLE WEIGHTING

CROSS-REFERENCE TO RELATED APPLICATIONS

The present application in a Continuation (CON) of U.S. patent application Ser. No. 17/898,896, filed Aug. 30, 2022, the disclosure of which is incorporated by reference in its entirety.

FIELD OF THE INVENTION

The present invention relates generally to an improved adjustable weighting system for an iron and/or wedge type golf club head. More specifically, the golf club head in accordance with the present invention relates to an improved weighting system that fits in seamlessly with the traditional shaping of a wedge type golf club head that preserves the aesthetics of a golf club head that golfers have come to expect while instilling confidence.

BACKGROUND OF THE INVENTION

In the game of golf, every golfer's swing is a little different from the next one. Consequently, what is best for one golfer may not always be the best for another golfer. In one example, one golfer may require a golf club that provides a lot of forgiveness, while in another example, the other golfer may require a golf club that provides more precision. In the golfing equipment industry, different types and models of golf clubs have traditionally been provided to meet the different needs of the various golfers.

With the continued development of innovation with golf club technology, golf club designers have been capable of incorporating adjustability in a golf club head to try and meet the varying needs of a golfer. U.S. Pat. No. 8,088,019 to Long et al. illustrates an example of adding an adjustable hosel mechanism to a golf club head, allowing the loft, lie, and face angle of a golf club head to be adjusted to accommodate the needs of a golfer.

In addition to adjustable hosel technology, U.S. Pat. No. 7,410,425 to Willett et al. illustrates that weighting in a golf club head may also be adjusted via one or more weighting screws that may have different densities, altering the center of gravity of the golf club head, providing a golfer with different ball flight characteristics depending on the needs of a golfer.

U.S. Pat. No. 8,696,491 to Myers provide another way to provide adjustability in a metalwood golf club head via a track weighting system instead of plurality of individual weights, allowing a single a weight to be moved along a track in a golf club head, also manipulating the center of gravity and the performance of the golf club head.

The utilization of adjustable weighting is not only applicable in metalwood type golf club heads as shown above, but also can be used in an iron type context to achieve similar objectives. U.S. Pat. No. 6,015,354 to Ahn et al. illustrates one of the earlier efforts to adjust weighting in an iron type golf club head using various types of adjustments that are very visual. Maintaining clean visual aesthetics is a very important feature in a golf club design, as it is often associated with the confidence of a golfer.

U.S. Pat. No. 8,777,774 to Kim et al. provides a more modern day attempt to adjust the weighting of a golf club head, but this time attempting to preserve the overall look of the golf club head.

All of the above exemplary advancements in golf club head performance have been very effective in adjusting the weighting and center of gravity of a golf club head. However, despite all the advancements above, none of the references has truly provided a aesthetically pleasing way to provide adjustment of weighting and thus the center of gravity of the golf club head all while preserving the shape and look of a traditional golf club head.

BRIEF SUMMARY OF THE INVENTION

In one aspect, the techniques described herein relate to a golf club head including: a body further including; a striking face, defining a striking face plane, having a lower edge; a sole extending rearward from the lower edge; and a back portion positioned rearward of the striking face and coupled to a rearward portion of the sole, a rear cavity formed near the sole of the body portion; and a weight assembly further including; a cover adapted to completely cover the rear cavity further including; an internal heel receptacle, an internal toe receptacle, and a through bore, separating the internal heel receptacle and the internal toe receptacle, a weight adapted to engage at least a portion of at least one of the internal heel receptacle or the internal toe receptacle, and a fastener, adapted to engage the through bore to secure the cover to the body, wherein the cover completely conceals the weight from view when the weight is installed within at least one of the internal heel receptacle or the internal toe receptacle of the cover, when the cover is fully secured to the rear cavity via the fastener.

In another aspect, the techniques described herein relate to a golf club head including: a body further including; a striking face, defining a striking face plane, having a lower edge; a sole extending rearward from the lower edge; and a back portion positioned rearward of the striking face and coupled to a rearward portion of the sole, a rear cavity formed near the sole of the body portion; and a weight assembly further including; a cover adapted to completely cover the rear cavity further including; an internal heel receptacle, an internal toe receptacle, and a through bore, separating the internal heel receptacle and the internal toe receptacle, a weight adapted to engage at least a portion of at least one of the internal heel receptacle or the internal toe receptacle, and a fastener, adapted to engage the through bore to secure the cover to the body, wherein the fastener moves along a weight axis, and wherein the weight axis forms an angle $\alpha$ with the striking face plane of between about −10 degrees to about +10 degrees.

In another aspect, the techniques described herein relate to a golf club head including: a body further including; a striking face, defining a striking face plane, having a lower edge; a sole extending rearward from the lower edge; and a back portion positioned rearward of the striking face and coupled to a rearward portion of the sole, a rear cavity formed near the sole of the body portion; and a weight assembly further including; a cover adapted to completely cover the rear cavity further including; an internal heel receptacle, an internal toe receptacle, and a through bore, separating the internal heel receptacle and the internal toe receptacle, a weight adapted to engage at least a portion of at least one of the internal heel receptacle or the internal toe receptacle, and a fastener, adapted to engage the through bore to secure the cover to the body, wherein the weight assembly is capable of a delta change along a x-axis ($\Delta x$) of between about 0 mm to about 2.5 mm.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Before beginning the discussion on the current inventive golf club head and its performance criteria, it is worthwhile to note here that the discussion below will be based on a coordinate system 301 (shown in FIG. 3) and axis of measurement that is critical to the proper valuation of the performance numbers. Hence, it is important to recognize here that although the specific names given for the measurements below are important to the understanding of the current invention, the naming nomenclature should not be viewed in vacuum. Rather, the importance is the numbers presented below needs to be taken in context with how the coordinate system relates to the golf club head itself. In order to provide sufficient information to avoid any ambiguity, each of the figures provided below referencing a golf club head will all be accompanied by a coordinate system that is all consistent with one another.

Figure 5:
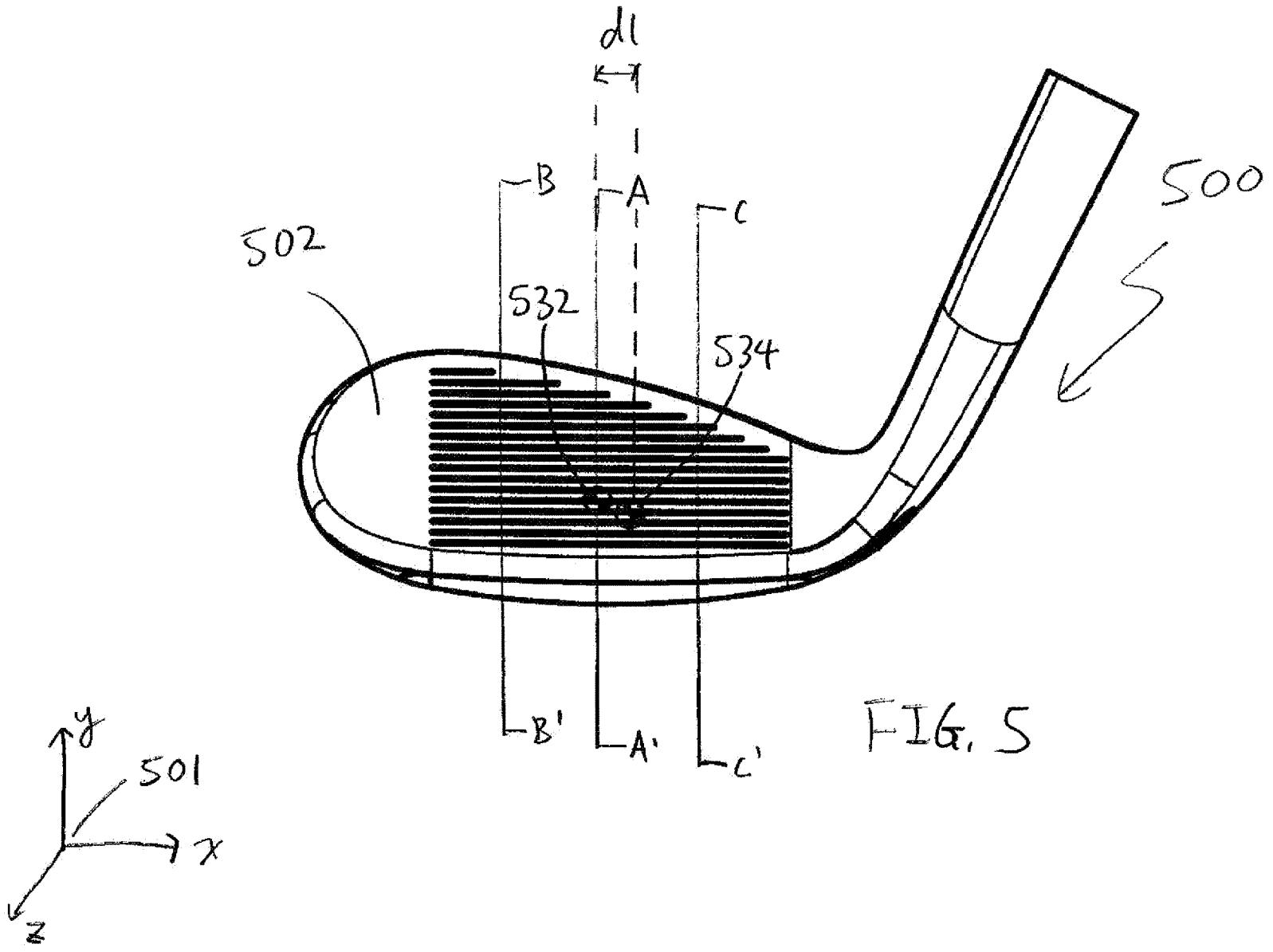
FIG. 5 of the accompanying drawings shows a frontal view of a golf club head in accordance with an embodiment of the present invention.

Pursuant to the above, and to establish the reference coordinate system for the subsequent discussion, FIG. 5 of the accompanying drawings shows the coordinate system 501 that will be used to define the various measurement and performance figures for the current invention. The x-axis used by the current discussion refers to the axis that is horizontal to the striking face from a heel to toe direction. The y-axis used by the current discussion refers to the vertical axis through the club in a crown to sole direction. The z-axis used by the current discussion refers to the horizontal axis that is horizontal front to back in a forward and rear direction. Alternatively speaking, it can be the x-axis is defined as a horizontal axis tangent to a geometric center of the striking face with the positive direction towards a heel of the golf club head, a y-axis is a vertical axis orthogonal to the x-axis with a positive direction towards a top of the golf club head, and a z-axis being orthogonal to both the x-axis and the y-axis with a positive direction towards a front of the golf club head. The x-y-z coordinate system described above shall be the same for all subsequent discussions.

Figure 1:
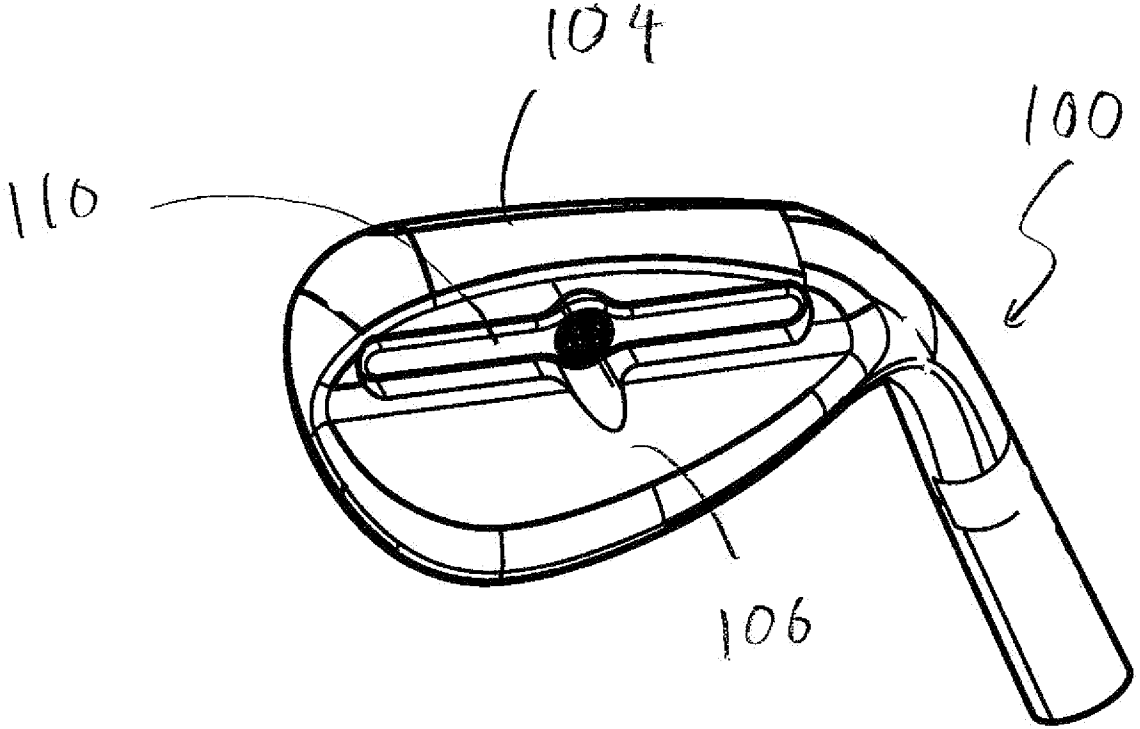
FIG. 1 of the accompanying drawings shows a perspective view of a golf club head in accordance with an embodiment of the present invention.

FIG. 1 of the accompanying drawings shows a perspective view of a golf club head 100 in accordance with an embodiment of the present invention. The golf club head 100 shown here in FIG. 1 may have a body that has a striking face 502 (shown in FIG. 5), a sole 104 extending rearward from a lower leading edge of the striking face 502 (shown in FIG. 5), and a back portion 106 positioned rearward of the striking face 502 (shown in FIG. 5) that is coupled to the rear portion of the sole 104. The golf club head 100, in accordance with this embodiment of the present invention may also have a rear cavity 208 (shown in FIG. 2) adapted to receive a weight assembly 110. The rear cavity 208 (shown in FIG. 2) is generally located within the muscle portion of the golf club head 100 to create a seamless and aesthetically pleasing visual in accordance with one of the main objectives of the present invention.

Figure 2:
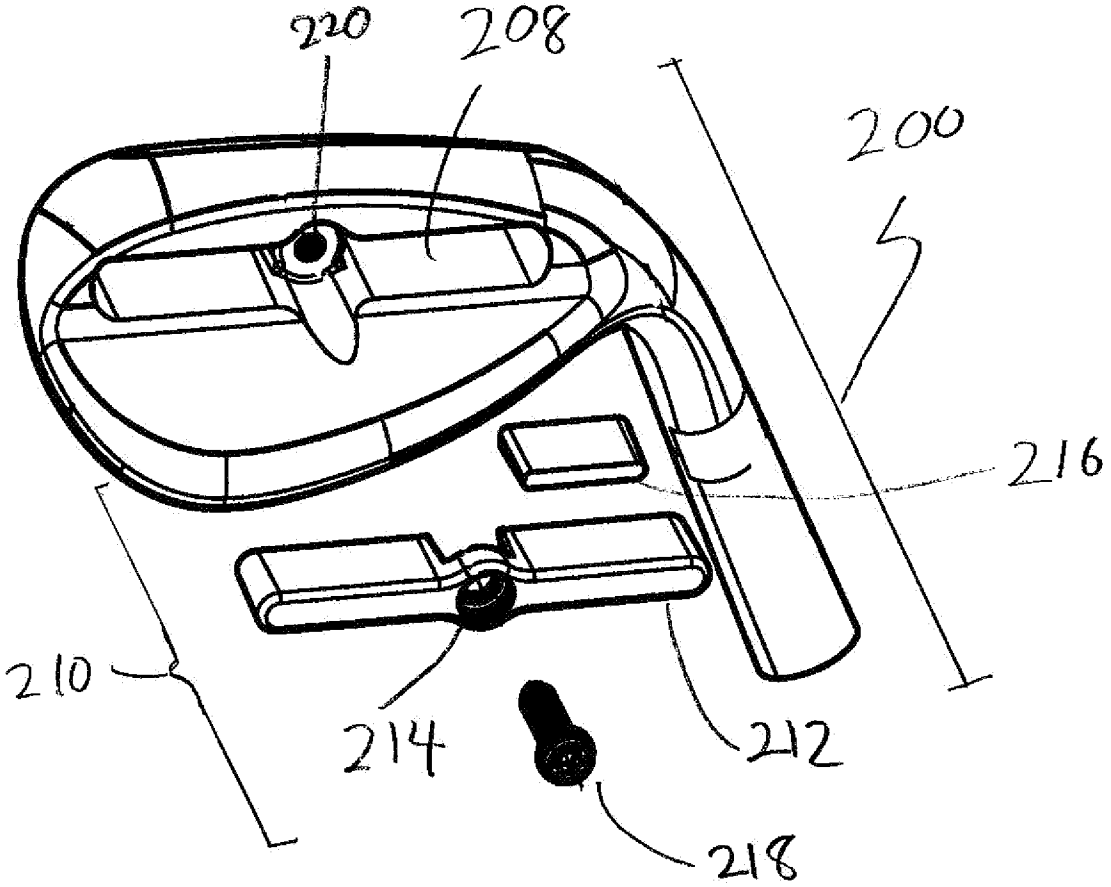
FIG. 2 of the accompanying drawings shows an exploded view of a golf club head in accordance with an embodiment of the present invention.

FIG. 2 of the accompanying drawings shows an exploded view of a golf club head 200 in accordance with an embodiment of the present invention. In this exploded view of the golf club head 200 shown in FIG. 2, with the weight assembly 210 removed from the rear cavity 208, we can see how the various components of the weight assembly 210 interface with the rear cavity 208. The weight assembly 210 shown here is further comprised out of a cover 212 that is shaped and sized to completely cover the void created by the rear cavity 208. The cover has an internal heel receptacle 322 (shown in FIG. 3) and an internal toe receptacle 324 (shown in FIG. 3), separated by a through bore 214, both of which are adapted to receive the weight 216. The fastener 218 shown in FIG. 2 allows the entirety of the weight assembly 210, including the weight 216 that is internally installed in the cover 212 is secured to the rear cavity 208 when a fastener 218 engaged a threaded receptacle 220 within the rear cavity 208.

It is worth noting here that the weight 216 may be installed into the internal heel receptacle 322 (shown in FIG. 3) or the internal toe receptacle 324 (shown in FIG. 3) to help adjust the center of gravity of the golf club head 200 depending on which receptacle its installed in. In fact, the present invention envisions that the weight 216 may not be sized to fill out the entirety of the internal heel receptacle 322 (shown in FIG. 3) or the internal toe receptacle 324 (shown in FIG. 3), further allowing for additional adjustments to the center of gravity of the golf club head 200 depending on where it is installed within each of the receptacles.

The weight 216 shown in this embodiment of the present invention may generally be made out of a high density material having a density of greater than about 12 g/cc, more preferably having a density of greater than about 14 g/cc, and most preferably having a density of greater than about 17 g/cc. In one exemplary embodiment, the preferred material for the weight 216 may be a tungsten type material, however, in alternative embodiments other various types of materials may also be used without departing from the scope and content of the present invention so long as it has a density higher than steel.

A closer comparison of the fully assembled golf club head 100 shown in FIG. 1 and the exploded view of golf club head 200 shown in FIG. 2 will illustrate one of the critical and key features of the present invention, wherein the cover 212 completely conceals the weight 216 from view when the cover 212 is fully secured to the rear cavity 208 of the golf club head 200. This feature is different from other type of tracked weighting systems where an indicator is required to identify the location, which is critical to the current wedge type design because unlike other types of golf clubs that are not subjected to heavy ground impacts, wedge type golf club heads need to be durable under impact with various turf conditions, including bunkers, making this feature critical to the present invention.

Figure 3:
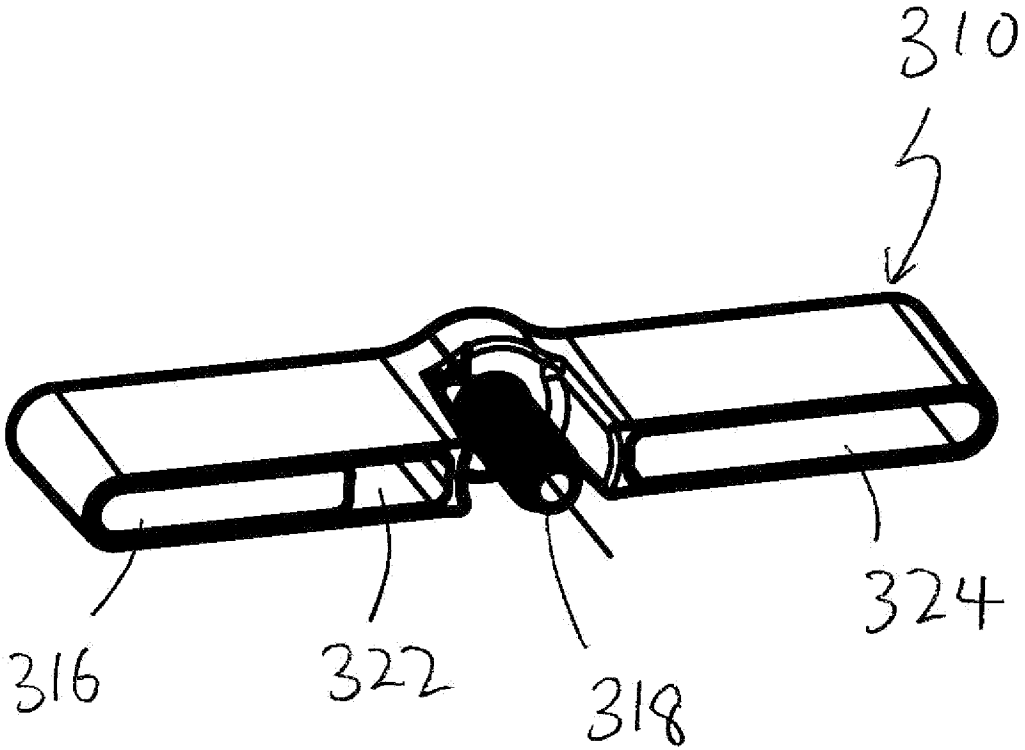
FIG. 3 of the accompanying drawings shows an internal perspective view of the weight assembly in accordance with an embodiment of the present invention.

FIG. 3 of the accompanying drawings shows an internal perspective view of the weight assembly 310 in accordance with an embodiment of the present invention. The internal perspective view of the weight assembly 310 allows the internal heel receptacle 322 and the internal toe receptacle 324 to be shown more clearly. In this embodiment of the present invention shown in FIG. 3, the weight 316 is installed in the internal heel receptacle 322, while the internal toe receptacle 324 remains empty. Having the high density weight 316 installed in the internal heel receptacle 322 will allow the center of gravity of the golf club head to be shifted towards the heel side of the golf club head, while the opposite would be true if the weight 316 is installed in the internal toe receptacle 324. Finally, FIG. 3 of the accompanying drawings also illustrates the fastener 318 separating the internal heel receptacle 322 from the internal toe receptacle 324, wherein the fastener 318 is adapted to engage the threaded receptacle 220 (shown in FIG. 2) to secure the weight assembly 310 to the golf club head.

It should be noted here that the weight 316, as shown in FIG. 3 may not completely fill up the entirety of the internal heel receptacle 322, and in this embodiment shown, only fill up the terminal side of the internal heel receptacle 322, leaving a gap in the proximal side of the internal heel receptacle 322. However, it should be noted that in alternative embodiment of the present invention, the weight 316 could occupy numerous other locations with either the internal heel receptacle 322 or the internal toe receptacle 324 all without departing from the scope and content of the present invention.

Figure 4:
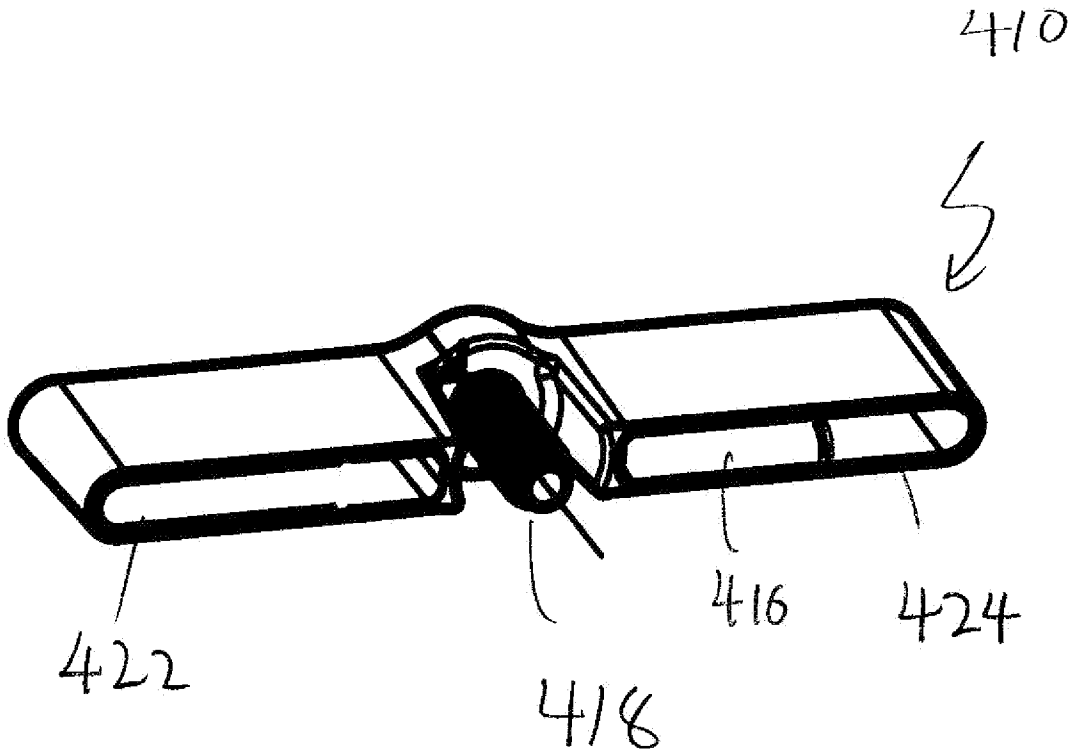
FIG. 4 of the accompany drawings shows another internal perspective view of the weight assembly in accordance with a further alternative embodiment of the present invention.

FIG. 4 of the accompany drawings shows a one of the alternative locations for the weight 416 within the internal toe receptacle 424 instead of the internal heel receptacle 422. In addition to showing an embodiment on how the weight can be placed in an alternative location within the internal toe receptacle 424, FIG. 4 of the accompanying drawings also shows that the placement of the weight within the internal toe receptacle 424 could also differ. In the weight assembly 410 shown in FIG. 4, the weight 416 can be placed closer to the fastener 418 at the proximal end of the internal toe receptacle 424, leaving a gap at the distal end of the internal toe receptacle 424. Needless to say, in a further alternative embodiment of the present invention, the weight 416 may also be placed in a proximal end of the internal heel receptacle 422 without departing from the scope and content of the present invention.

FIG. 5 of the accompanying drawings shows a frontal view of a golf club head 500, allowing the striking face 502 to be shown. In this frontal view of the golf club head 500 shown in FIG. 5, we can identify cross-sectional lines A-A', B-B', and C-C', the details of which will be shown later. The cross-sectional line A-A' passes through the center of the fastener 218 (shown in FIG. 2), the cross-sectional line B-B' passes through a plane toeward of cross-sectional line A-A', and can illustrate the empty side of the internal toe receptacle, which in this embodiment, is shown as the empty cavity.

In addition to illustrating the cross-sectional lines along this x-y plane, FIG. 5 of the accompanying drawings also shows a face center 532 and a center of gravity 534 location of the golf club head 500. The face center 532 of the golf club head 500 is defined as the midpoint between the full length scorelines (ignoring any partial scorelines at the top of the striking face 502) along the x-axis, located on frontal striking surface of the striking face 502 on the fifth scoreline counting from the bottom. Highlighting the location of the center of gravity in the present invention is important because the adjustable weight assembly 210 (shown in FIG. 2) adjusts the location of the weight along the x-axis, thus the resultant center of gravity location along the x-axis will change depending on the location of the weight 216 (shown in FIG. 2) within the weight assembly 210 (shown in FIG. 2).

In this current embodiment of the present invention, the distance d1 of the center of gravity 534 along the x-axis away from the face center 532 may generally be between about 2 mm to about 8 mm, more preferably between about 3 mm to about 7 mm, and most preferably between about 3 mm to about 6 mm Because the range of center of gravity locations above relate to different wedge chassis having different lofts, the entirety of the CG distance range articulated above is generally not within the possibility of the adjustability. In reality, the change in center of gravity location of the wedge between the extremities of the weight placement within the internal heel receptacle 322 (shown in FIG. 3) and the internal toe receptacle 324 (shown in FIG. 3) of the weight assembly 310 (shown in FIG. 3) may result in a delta change, quantified as $\Delta x$ of between about 0 mm to about 2.5 mm, more preferably between about 0 mm to about 2.0 mm, and most preferably between 0 mm and about 1.8 mm, all without departing from the scope and content of the present invention. Alternatively speaking, it can be said that the weigh assembly 310 is capable of achieving a delta change along the x-axis ($\Delta x$) of between about 0 mm to about 2.5 mm, more preferably between about 0 mm to about 2.0 mm, and most preferably between 0 mm and about 1.8 mm.

Figure 6:
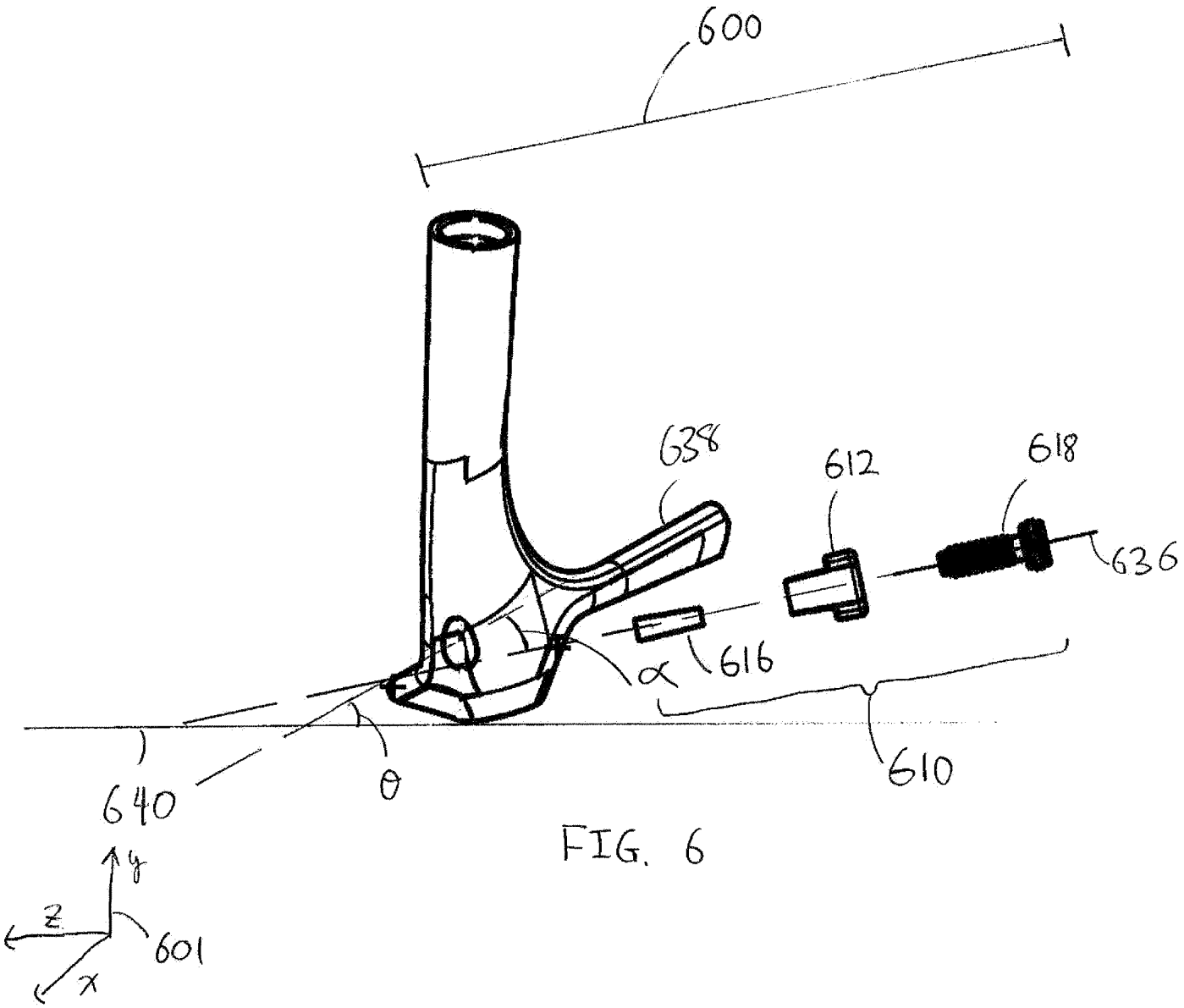
FIG. 6 of the accompanying drawings shows an exploded heel side view of a golf club head in accordance with an embodiment of the present invention.

FIG. 6 of the accompanying drawings shows an exploded heel side view of a golf club head 600 in accordance with an embodiment of the present invention. In this exploded view of the golf club head 600, it can be seen that the entirely of weight assembly 610 moves along a weight axis 636, which forms a weight assembly angle α with the loft plane 638 of the golf club head 600. The loft plane 638 shown here in FIG. 6 is a plane that is formed along x-z plane as shown in the coordinate system 601 and is intended to capture the loft of the golf club head 600. The loft plane 638 form a loft angle θ with the ground plane 640 that is greater than about 40 degrees, more preferably greater than about 43 degrees, and most preferably greater than about 45 degrees.

The weight assembly angle α is critical to the present invention because it ensures that the weight assembly 610 is strategically placed within the muscle portion of the golf club head 600. In the current exemplary embodiment of the present invention, the weight assembly angle α may generally be between −10 degrees and +10 degrees of the loft plane 638, more preferably between −5 degrees and +10 degrees of the loft plane 638, and most preferably between about 0 degrees and +10 degrees of the loft plane 638. In the embodiment shown in FIG. 6, the weight assembly angle α may be illustrated as a positive number, but a could also be a negative number as described above without departing from the scope and content of the present invention.

In addition to illustrating the two angles above, the exploded heel side view of the golf club head 600 also allows the cover 612, the weight 616, and the fastener 618 of the weight assembly 610 to be shown in more detail. In this specific embodiment of the present invention, the fastener 318 may be a double threaded screw that allows for ease of partial extraction to facilitate the flipping of the cover 612 of the weight assembly 610 also without departing from the scope and content of the present invention. In this embodiment of the present invention, the coarse thread portion of the double threaded fastener 618 may form the first 4 mm portion of the thread, allowing the first 4 mm of the disengagement process to occur quickly, while the remaining portion of the threads have a finer composition to prevent accidental removal of the entire cover 612 without departing from the scope and content of the present invention.

Figure 7:
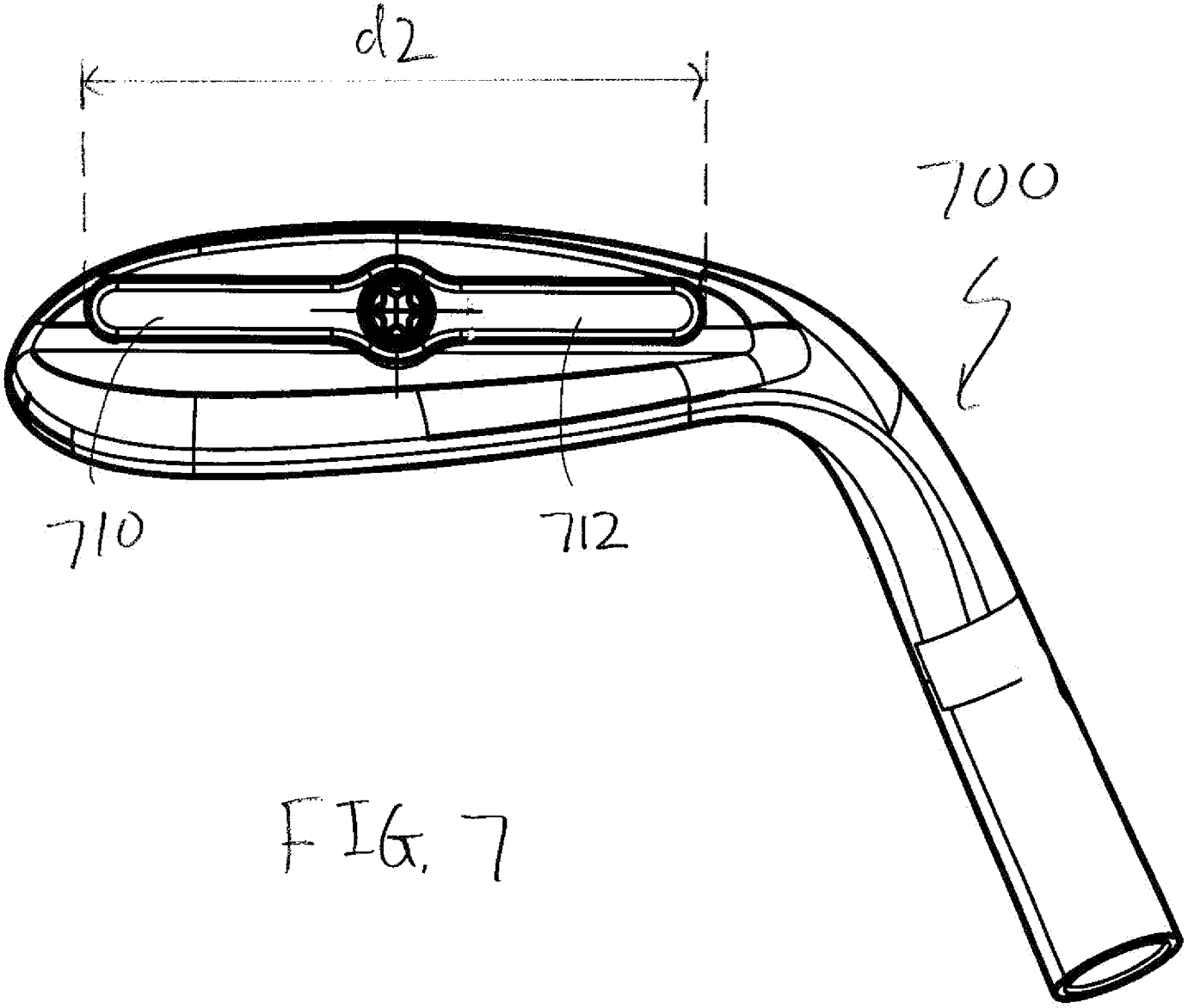
FIG. 7 of the accompanying drawings shows a rear view of a golf club head in accordance with an embodiment of the present invention.

FIG. 7 of the accompanying drawings shows a rear view of a golf club head 700 in accordance with an embodiment of the present invention. In this view of the invention shown in FIG. 7, it can be seen once again that when fully installed, the cover 712 of the weight assembly 710 is sized and shaped to have the same size and dimension as the rear cavity 208 (shown in FIG. 2) thus that in this rear view, the rear cavity 208 (shown in FIG. 2) is completely concealed. Moreover, as previously mentioned, the critical aspect of the present invention shown in FIG. 7 is that the weight that is inserted within either the internal heel receptacle or the internal toe receptacle is completely hidden and invisible from this view, which as previously discussed, is a critical aspect of the present invention.

In addition to reinforcing this key feature of the present invention, FIG. 7 of the accompanying drawings shows a weight assembly 710 width d2 that is measured from the heel most point of the weight assembly 710 to the toe most point of the weight assembly 710. Width d2, as shown in this embodiment of the present invention, may generally be greater than about 45 mm, more preferably greater than about 50 mm, and most preferably greater than about 55 mm, all without departing from the scope and content of the present invention.

Figure 8:
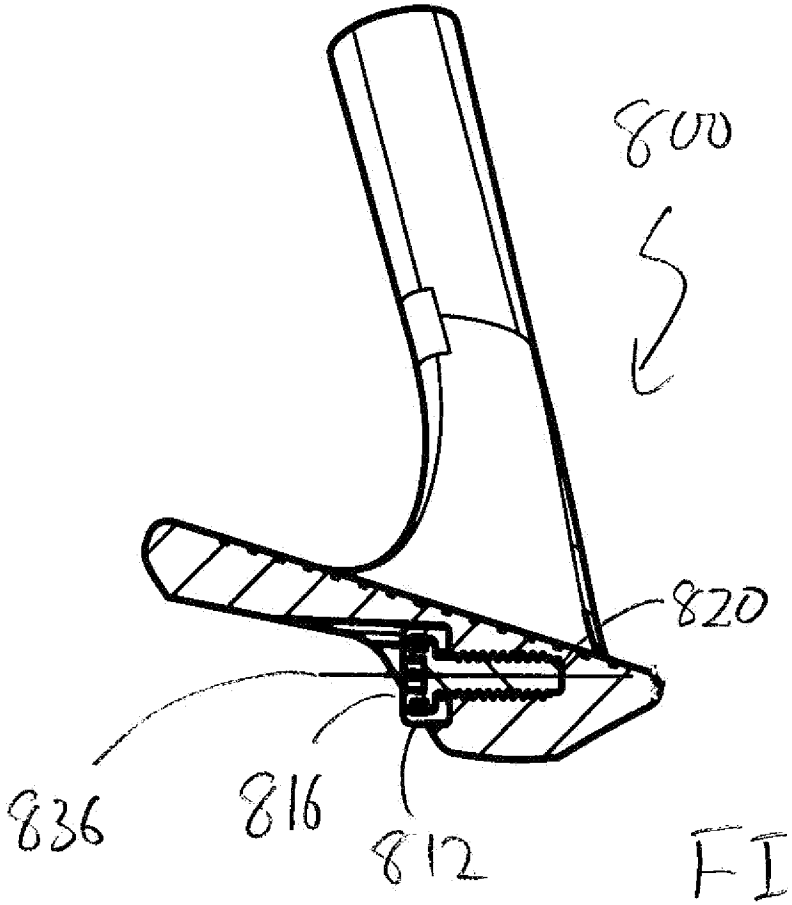
FIG. 8 of the accompanying drawings shows a cross-sectional view of a golf club head taken along cross-sectional line A-A' shown in FIG. 5, in accordance with an embodiment of the present invention.

FIG. 8 of the accompanying drawings shows a cross-sectional view of a golf club head 800 taken along cross-sectional line A-A' shown in FIG. 5, down the middle of the club head where the fastener 816 is located. This cross-sectional view of the golf club head 800 taken along cross-sectional line A-A' illustrates the how the internal components of the fastener 812 can be used to secure the cover 810 into a threaded receptacle 820 of the rear cavity along the weight axis 836.

Figure 9:
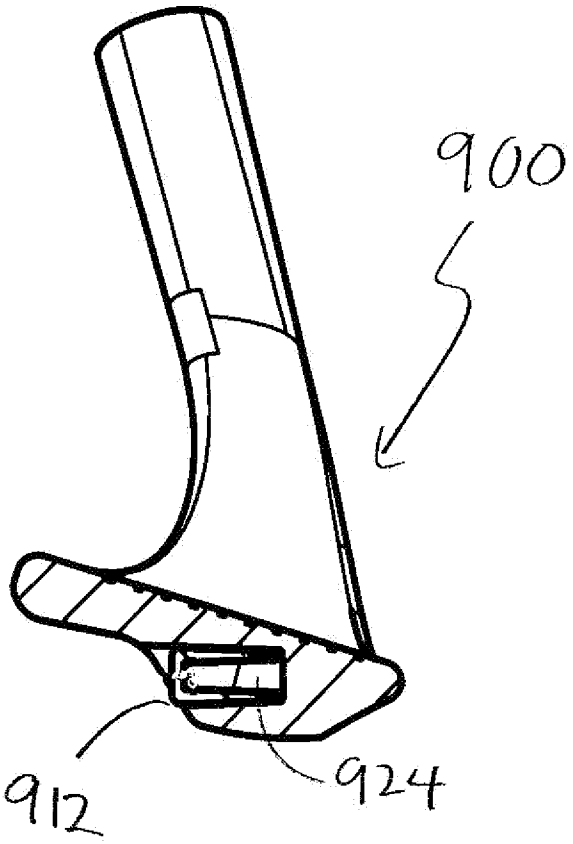
FIG. 9 of the accompanying drawings shows a cross-sectional view of a golf club head taken along cross-sectional line B-B' shown in FIG. 5, in accordance with an embodiment of the present invention.

FIG. 9 of the accompanying drawings shows a cross-sectional view of a golf club head 900 taken along cross-sectional line B-B' shown in FIG. 5, at a location that bisects the internal toe receptacle 924. This cross-sectional view of the golf club head 900 taken along cross-sectional line B-B' illustrates the internal component of the cover 912 concealing the rear cavity, wherein the internal toe receptacle 924 does not contain any weight.

Figure 10:
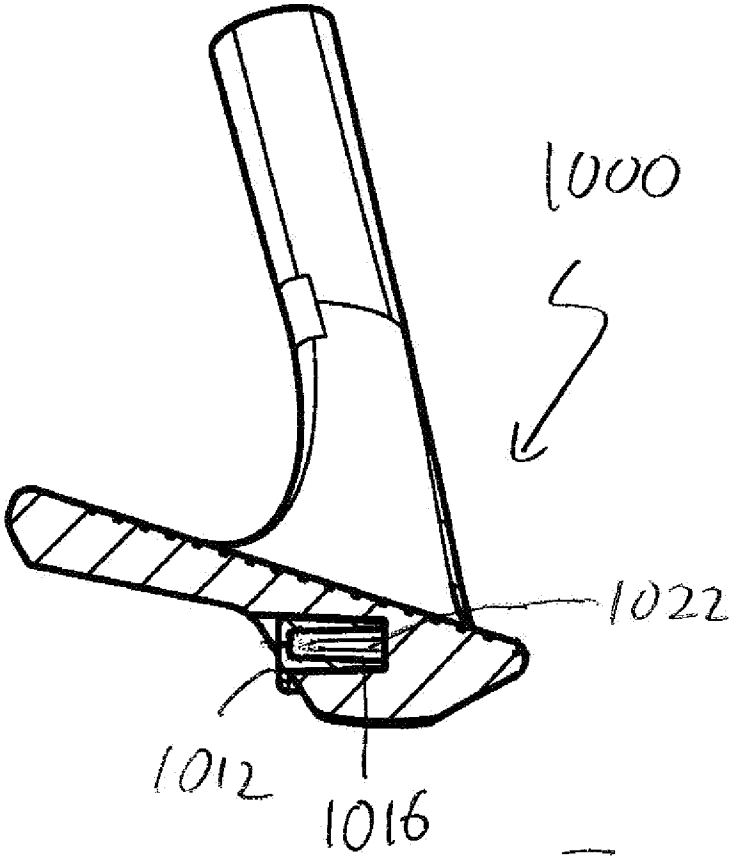
FIG. 10 of the accompanying drawings shows a cross-sectional view of a golf club head taken along cross-sectional line C-C' shown in FIG. 5, in accordance with an embodiment of the present invention.

FIG. 10 of the accompanying drawings shows a cross-sectional view of a golf club head 1000 taken along cross-sectional line C-C' shown in FIG. 5, at a location that bisects the internal heel receptacle 1022. This cross-sectional view of the golf club head 1000 taken along cross-sectional line C-C' illustrates the internal components of the cover 1012 concealing the rear cavity, wherein the internal heel receptacle 1022 does contain a weight 1016.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a body portion further comprising;

a striking face, defining a striking face plane, having a lower edge;

a sole extending rearward from said lower edge; and a back portion positioned rearward of said striking face and coupled to a rearward portion of said sole, a rear cavity formed near said sole of said body portion, and a weight assembly further comprising;

a cover adapted to completely cover said rear cavity further comprising;

an internal receptacle, and a through bore, a weight adapted to engage said internal receptacle, and a fastener, adapted to engage said through bore of said cover to secure said cover to said body portion, wherein said cover completely conceals said weight from view when said weight is installed within said internal receptacle, wherein said weight assembly is capable of a delta change along an x-axis ($\Delta x$) of between about 0 mm to about 2.5 mm, wherein said fastener moves along a weight axis, and wherein said weight axis forms an angle $\alpha$ with said striking face plane of between about −10 degrees to about +10 degrees.

2. The golf club head of claim 1, wherein a distance d1 between a center of gravity of said golf club head and a face center is between about 2 mm to about 8 mm.

3. The golf club head of claim 2, wherein said distance d1 is between about 3 mm to about 7 mm.

4. The golf club head of claim 3, wherein said distance d1 is between about 3 mm to about 6 mm.

5. The golf club head of claim 1, wherein said weight assembly is capable of achieving said delta change along said x-axis ($\Delta x$) of between about 0 mm to about 2.0 mm.

6. The golf club head of claim 5, wherein said weight assembly is capable of achieving said delta change along said x-axis ($\Delta x$) of between about 0 mm to about 1.8 mm.

7. The golf club head of claim 1, wherein said angle $\alpha$ is between about −5 degrees and about +10 degrees.

8. The golf club head of claim 7, wherein said angle $\alpha$ is between about 0 degrees and about +10 degrees.

9. A golf club head comprising:

a body portion further comprising;

a striking face, defining a striking face plane, having a lower edge;

a sole extending rearward from said lower edge; and a back portion positioned rearward of said striking face and coupled to a rearward portion of said sole, a rear cavity formed near said sole of said body portion, and a weight assembly further comprising;

a cover adapted to completely cover said rear cavity further comprising;

an internal receptacle, and a through bore, a weight adapted to engage said internal receptacle, and a fastener, adapted to engage said through bore of said cover to secure said cover to said body portion, wherein said cover completely conceals said weight from view when said weight is installed within said internal receptacle, and wherein said fastener moves along a weight axis, and, wherein said weight axis forms an angle $\alpha$ with said striking face plane of between about −10 degrees to about +10 degrees.

10. The golf club head of claim 9, wherein said angle $\alpha$ is between about −5 degrees and about +10 degrees.

11. The golf club head of claim 10, wherein said angle $\alpha$ is between about 0 degrees and about +10 degrees.

12. The golf club head of claim 11, wherein said weight only partially fills said internal receptacle.

13. The golf club head of claim 12, wherein said weight occupies a terminal side of said internal receptacle.

* * * * *